United States Patent [19]

Sheahan

[11] 4,067,166

[45] Jan. 10, 1978

[54] RETAINING BLOCK

[76] Inventor: Edmund C. Sheahan, One Orchard St., Wellesley Hills, Mass. 02181

[21] Appl. No.: 586,202

[22] Filed: June 12, 1975

[51] Int. Cl.[2] ..... E02D 5/00

[52] U.S. Cl. ..... 52/593; 52/610; 61/39

[58] Field of Search ..... 61/37, 39, 49; 52/593, 52/610

[56] References Cited

U.S. PATENT DOCUMENTS

| | | | |
|---|---|---|---|
| 1,778,574 | 10/1930 | Thornley | 61/39 |
| 1,812,364 | 6/1931 | Oursler | 61/39 |
| 2,820,349 | 1/1958 | Cooper | 61/39 X |
| 3,252,287 | 5/1966 | Suzuki | 61/37 X |
| 3,282,054 | 11/1966 | Saginor | 61/39 X |
| 3,800,491 | 4/1974 | Gunia | 52/610 X |

FOREIGN PATENT DOCUMENTS

| | | | |
|---|---|---|---|
| 747,703 | 6/1933 | France | 61/49 |
| 8,814 of | 1900 | United Kingdom | 61/39 |

*Primary Examiner*—Casmir A. Nunberg
*Assistant Examiner*—David H. Corbin
*Attorney, Agent, or Firm*—Wolf, Greenfield & Sacks

[57] ABSTRACT

The block is preferably used in the construction of a retaining wall which would be constructed from a plurality of these blocks laid in a similar manner to the laying of conventional concrete blocks. The block of this invention is generally T-shaped having a facing wall and a somewhat elongated support wall.

3 Claims, 4 Drawing Figures

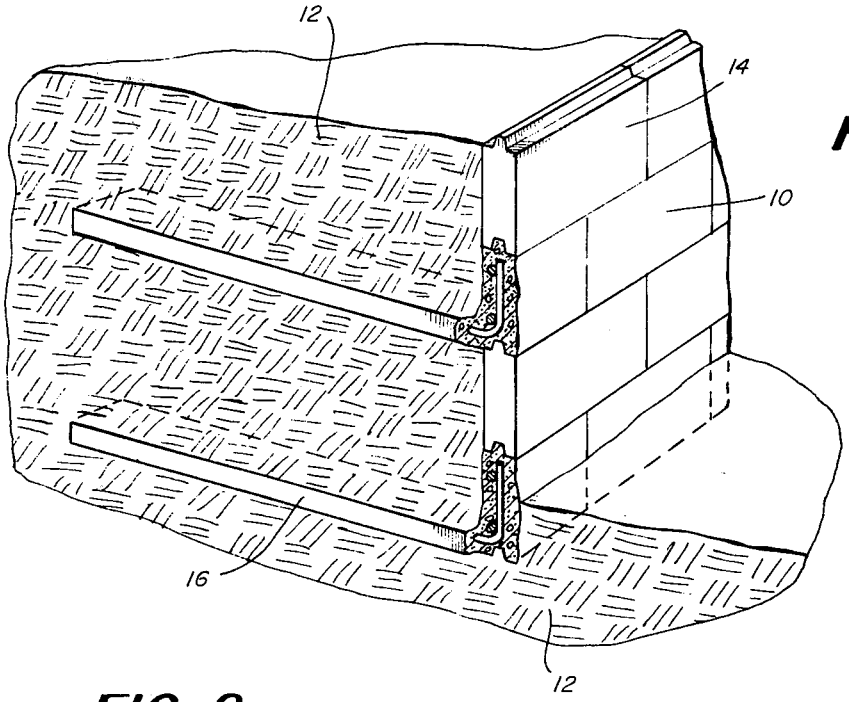
FIG. 1
FIG. 2
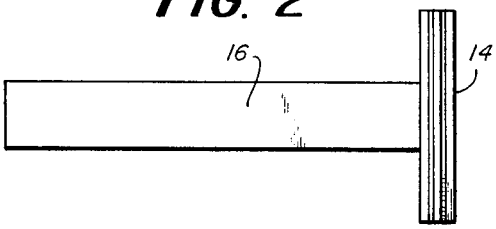
FIG. 3
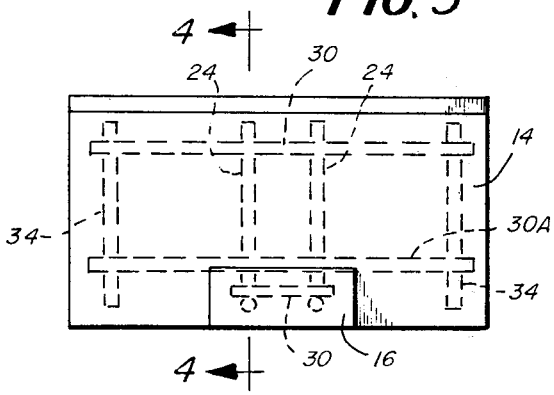
FIG. 4
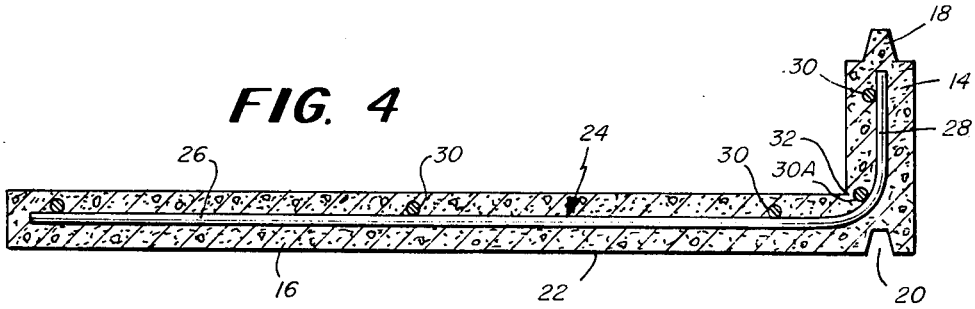

RETAINING BLOCK

BACKGROUND OF THE INVENTION

The present invention relates, in general, to a prefabricated building block and is more particularly concerned with a reinforced concrete block preferably for constructing retaining walls.

Some retaining walls are constructed from conventional concrete blocks. These blocks are joined by cement mortar. Some of the problems associated with the walls constructed in this manner are that the wall is costly and time consuming to make, the blocks are relatively hard to handle, and the wall is very susceptible to cracking and deterioration due to lateral forces on the wall from the retained earth.

The prior art also teaches the use of blocks that are specifically made for constructing retaining walls. In this connection, reference is made to U.S. Pat. No. 3,282,054 to Saginor. This patent shows a T-shaped concrete block. However, there are certain disadvantages associated with the specific structure taught by this patent. In the first place because of the particular construction of the block, it is quite difficult to construct the block by any well known pouring technique using a mold. Also, this prior art block is susceptible to breakage problems and because of the particular construction of the prior art block, it is difficult to properly back fill the earth about the block.

Accordingly, one object of the present invention is to provide an improved reinforced concrete block preferably adapted for constructing retaining walls.

Another object of the present invention is to provide a retaining block that is reinforced preferably by means of reinforcing rods to provide a more durable block.

A further object of the present invention is to provide a reinforced concrete block that is easier to construct and easier to work with.

Still another object of the present invention is to provide an improved reinforced concrete block that is constructed in the manner that permits proper back filling of the earth that covers a portion of the block.

SUMMARY OF THE INVENTION

To accomplish the foregoing and other objects of this invention there is provided a block which is used in constructing a retaining wall. This block comprises two basic sections including a facing wall portion and a somewhat elongated support bar integrally formed with the facing wall portion. The facing wall portion is of generally parallelepiped construction and has a facing surface, a rear surface, a top surface and a bottom surface. The elongated support bar extends rearwardly from the rear surface and has a bottom surface that is flush with the bottom surface of the facing wall portion. Preferably, each of the blocks has a tongue and groove arrangement in its top and bottom surfaces to achieve interlocking between adjacent blocks. The block structure also has a reinforcing means in the form of somewhat elongated rods or bars which are of L-shape having one leg embedded in the facing wall portion and another leg embedded in the support bar.

BRIEF DESCRIPTION OF THE DRAWINGS

Numerous other objects, features and advantages of the invention will now become apparent upon a reading of the following detailed description taken in conjunction with the accompanying drawings, in which:

FIG. 1 is a perspective view which is partially cut away showing a retaining wall constructed with the blocks of this invention;

FIG. 2 is a plan view of the block of this invention;

FIG. 3 is a rear view of the block; and

FIG. 4 is a cross sectional view taken along line 4—4 of FIG. 3.

DETAILED DESCRIPTION

FIG. 1 shows a retaining wall composed of the blocks 10 of this invention. The retaining wall is for retaining the earth 12. Typically, a retaining wall is used to prevent earth on a slope from washing away. It provides a step between two different levels of earth. As shown in FIG. 1, the first course of blocks 10 may be disposed on both sides completely or partially under the earth 12. The blocks 10 of FIG. 1 are arranged in a similar manner to the arrangement of a typical concrete block wall. When the retaining wall is finished, in fact, it has the appearance of a concrete block wall without the requirement of mortar being used between the blocks.

Each of the blocks 10 comprise a facing wall portion 14 and a somewhat elongated support bar or lever 16. These two portions of the block are integrally formed as clearly indicated in FIGS. 1 and 4. The block is composed basically of a concrete mixture and is constructed in a mold. The portion 14 is of generally rectangular shape and has a top tongue 18 extending therealong. The bottom surface of the portion 14 has a groove 20 which interlocks with a tongue 18 on an adjacent block. It is noted that the elongated support bar 16 has a bottom surface 22 which is flush with the bottom surface of the facing wall portion 14. Also, the length of the bar 16 is preferably several times the height of the facing wall portion 14. In the embodiment shown in FIG. 4, the length of the support bar is approximately four times the height of the facing wall portion. However, this ratio is not necessarily fixed. For a high wall of say 6 feet or greater, this ratio could be 4 to 1 but for a lower wall the ratio could be less. For a low wall of 8–24 inches in height the support bar may be 24 inches long.

This construction, that is where the support bar extends from the bottom end of the facing wall portion, is most advantageous as far as constructing the wall is concerned. With this arrangement, one can start with a flat surface and rest the block on that surface. The earth is then filled to the top of the block and the next course of blocks is laid upon the first course.

The block shown on the drawing is also provided with a reinforcing means which is most clearly shown in FIG. 4. This reinforcing means comprises a rod 24 of generally L-shape having a long leg 26 embedded within the support bar 16 and a shorter leg 28 embedded within the facing wall portion 14. As shown in dotted in FIG. 3, there are two reinforcing rods 24 of this type that extend along the support bar 16. In addition, there are a plurality of cross bars 30 shown in FIGS. 3 and 4 which interconnect between the L-shaped reinforcing rods 24 at predetermined intervals. It is noted, in particular, that there is one cross rod 30A disposed very near to the joint 32 to provide improved strength at that point which is a critical area of the block where minute cracking might occur. FIG. 3 also shows in dotted, two additional rods 34 which may extend between the two longer rods 30 and 30A shown in FIG. 3. All of the reinforcing rods must be inserted into the mold and may be tack welded together prior to the placing of the concrete.

It has been found that by constructing the supporting bar 16 relatively long in comparison to the height of the facing wall, that a tremendous holding force is developed when the earth is piled on top of the supporting bar 16 thereby providing an extremely stable retaining wall. Also, it is preferred that the width of the bar, as most clearly shown in FIG. 3, be preferably about one third of the width of the facing wall portion and that the bar be disposed extending centrally from the rear wall as also clearly indicated in FIG. 3.

In summary, there are a number of advantages to the structure of this invention. For example, the block can easily be formed in a simple mold. This is possible at least in part because the support bar extends from an end of the facing wall portion. The block is also of very simple construction and may be molded to various dimensions and at the same time held to its basic "T" shape. The reinforcing rods make the block virtually indestructible for its intended use. With the blocks of this invention the retaining wall can be constructed almost perfectly vertically whereas with the use of concrete blocks many times it was preferred that the wall taper and be of various thicknesses so that it functioned properly. An important advantage of the present invention is that because the elongated bar of the block is at its bottom end, it is quite easy to properly fill and lay each individual course of blocks. The tongue and groove feature eliminates the need for cement mortar such as is required to hold the conventional concrete blocks together. Another important advantage of this invention is that the blocks may easily be laid by persons unskilled in masonry construction. Also, with the construction of the present invention, the wall is permitted to move up and down because of any frost action but with no damage because the wall is flexible rather than of rigid design. Also, if there is water behind the wall, the water can seep out between the blocks. This assures that no hydraulic head will laterally push the wall outwardly.

What is claimed is:

1. A block used in constructing a retaining wall composed of a number of blocks and comprising;

a facing wall portion of rectangular construction having a rectangular facing surface, a rectangular rear surface and top, bottom and side surfaces, said top and bottom surfaces of said facing wall portion having tongue and groove means permitting interlocking between blocks, an elongated support bar integral with the facing wall portion having a rectangular cross section and extending rearwardly from the rear surface and having a bottom surface that is substantially flush with the bottom surface of the facing wall portion, said support bar having a width greater than its height and said facing wall portion having its width greater than the width of the support bar, a pair of elongated L-shaped reinforcing rods embedded in the block, each having only one short leg of only a linear rod section embedded in the facing wall portion and only one long leg of only a linear rod section embedded in the support bar, said elongated rods disposed in parallel with each rod forming a cantilever support within the block with the ends of the rod terminating free and in orthogonal directions.

a first straight long rod disposed in the facing wall portion parallel to the top surface thereof and means for welding the long rod to the L-shaped rods, a second straight long rod disposed adjacent the joining edge line between the top surface of the support bar and the rear surface of the facing wall portion and means for welding the second rod to the elongated rods at a position between the joining edge line and the bend in the elongated rods between the long and short legs, a plurality of shorter straight rods all disposed in parallel to each other within the support bar and means for welding the shorter rods to the two elongated rods.

2. A block as set forth in claim 1 wherein both said long rods one of equal length and terminate at their ends just adjacent the side surfaces of the facing wall portion.

3. A block as set forth in claim 2 wherein all short rods are of the same length and are equally spaced.

* * * * *